US010414554B2

(12) United States Patent
Robinson

(10) Patent No.: US 10,414,554 B2
(45) Date of Patent: Sep. 17, 2019

(54) WATER BOTTLE INSERT

(71) Applicant: Matthew Scott Robinson, Colorado Springs, CO (US)

(72) Inventor: Matthew Scott Robinson, Colorado Springs, CO (US)

( * ) Notice: Subject to any disclaimer, the term of this patent is extended or adjusted under 35 U.S.C. 154(b) by 36 days.

(21) Appl. No.: 15/630,770

(22) Filed: Jun. 22, 2017

(65) Prior Publication Data

US 2017/0367510 A1 Dec. 28, 2017

Related U.S. Application Data

(60) Provisional application No. 62/353,194, filed on Jun. 22, 2016.

(51) Int. Cl.

| | |
|---|---|
| ***B65D 47/06*** | (2006.01) |
| ***A45F 3/16*** | (2006.01) |
| *B65D 47/00* | (2006.01) |
| *A47G 19/22* | (2006.01) |

(52) U.S. Cl.
CPC ..... *B65D 47/06* (2013.01); *A45F 3/16* (2013.01); *A47G 19/22* (2013.01); *B65D 47/00* (2013.01)

(58) Field of Classification Search
CPC ..... B65D 47/06; B65D 47/00; A45F 3/16; A47G 19/22
USPC ..... 215/252; 220/500–557, 563
See application file for complete search history.

(56) References Cited

U.S. PATENT DOCUMENTS 2,362,354 A * 11/1944 Clovis ..... A47G 19/2211 220/719
2,428,056 A * 9/1947 Wachsman ..... A47G 19/2211 220/529
2,850,083 A 9/1958 Frost
3,069,042 A 12/1962 Johnston
3,400,855 A * 9/1968 Alexander ..... A47G 19/2211 215/6
4,013,190 A 3/1977 Wiggins et al.
4,272,768 A * 6/1981 Rookard, Jr. ..... H01Q 15/18 215/12.2
4,294,279 A 10/1981 Wyeth
4,550,848 A 11/1985 Sucato
6,398,064 B1 6/2002 Cornwall
6,588,622 B1 7/2003 Leishman et al.
7,490,740 B2 2/2009 Robins et al.
8,887,962 B2 11/2014 Herivel et al.
(Continued)

OTHER PUBLICATIONS

Gas Tank Foam—Anti Slosh Foam Fuel Tank Foam. <http://www.ksrfoam.com/Gas_tank_foam_.php>.
(Continued)

*Primary Examiner* — Kareen K Thomas
(74) *Attorney, Agent, or Firm* — Faegre Baker Daniels LLP

(57) ABSTRACT

An insert made from reticulated foam has a first profile in which an outer perimeter of the insert has a size and a shape that substantially corresponds to an inner surface of a portable container. The insert also has a second profile in which the outer perimeter of the insert has a size and a shape that substantially corresponds to an opening of the portable container. The reticulated foam has a cell density that prevents sloshing noises resulting from jostling movement of the portable container from exceeding 50 db while enabling liquid to exit the portable container at a consumable rate.

19 Claims, 8 Drawing Sheets

(56) References Cited

U.S. PATENT DOCUMENTS

2006/0027611 A1 2/2006 Hobbs

OTHER PUBLICATIONS

"FuelCel Anti-Slosh Foam Baffling". <http://eti-fuelcel.com/Bafflfoam <http://eti-fuelcel.com/Bafflefoam.html>.
"Silent Water Stop the Slosh in Your Water Bottle". <http://silentwater.com/index.html>.

* cited by examiner

WATER BOTTLE INSERT

RELATED APPLICATIONS

This application claims the benefit of U.S. Provisional Patent Application No. 62/353,194, filed on Jun. 22, 2016. The contents of this application are incorporated herein by reference in their entireties for all purposes.

BACKGROUND

Portable liquid containers, such as water bottles and canteens, help people enjoy the outdoors without becoming dehydrated. Wilderness activities in particular may place hunters, hikers, and campers far from easy access to water, necessitating a portable source of water. Portable liquid containers are also useful in endurance sports such as running, skiing, and mountain biking, for example, where participants often carry portable water bottles to avoid dehydration, especially if the activity lasts for an extended amount of time outdoors.

Yet carrying a portable water bottle during such activities can result in uncomfortable, disruptive, and noisy sloshing of water. For example, sloshing noise may disrupt activities that rely on silence, such as bow hunting, as the sloshing noises may alert a potential target animal. Sloshing can also cause discomfort, for example, if a trail runner attaches a portable water bottle to their hip. While running, the water may shift from side to side after each step, rocking the water bottle back and forth in a manner that uncomfortably lags the natural cadence of the runner. Sloshing noises may also simply prove irritating through endless noisy repetition while hiking.

SUMMARY

According to some embodiments, an insert is placed into a portable water bottle. The insert is formed of compressible foam that passes through the opening of a portable water bottle when compressed. The foam then expands within the portable water bottle, extending from one interior side of the portable water bottle to the opposite interior side of the portable water bottle. The foam may also expand to extend from the bottom of the portable water bottle to an upper portion or even an upper surface of the interior of the portable water bottle. The insert foam is formed of many small cells that are in fluid communication with each other, such that liquid can flow between adjacent cells and out the water bottle at a consumable rate.

When the portable water bottle is in motion (e.g., subject to the sloshing motions from running), the insert reduces the noise associated with the sloshing of liquid inside of the portable water bottle. In addition, the insert reduces motion resulting from the sloshing of liquid against the interior walls of the portable water bottle.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
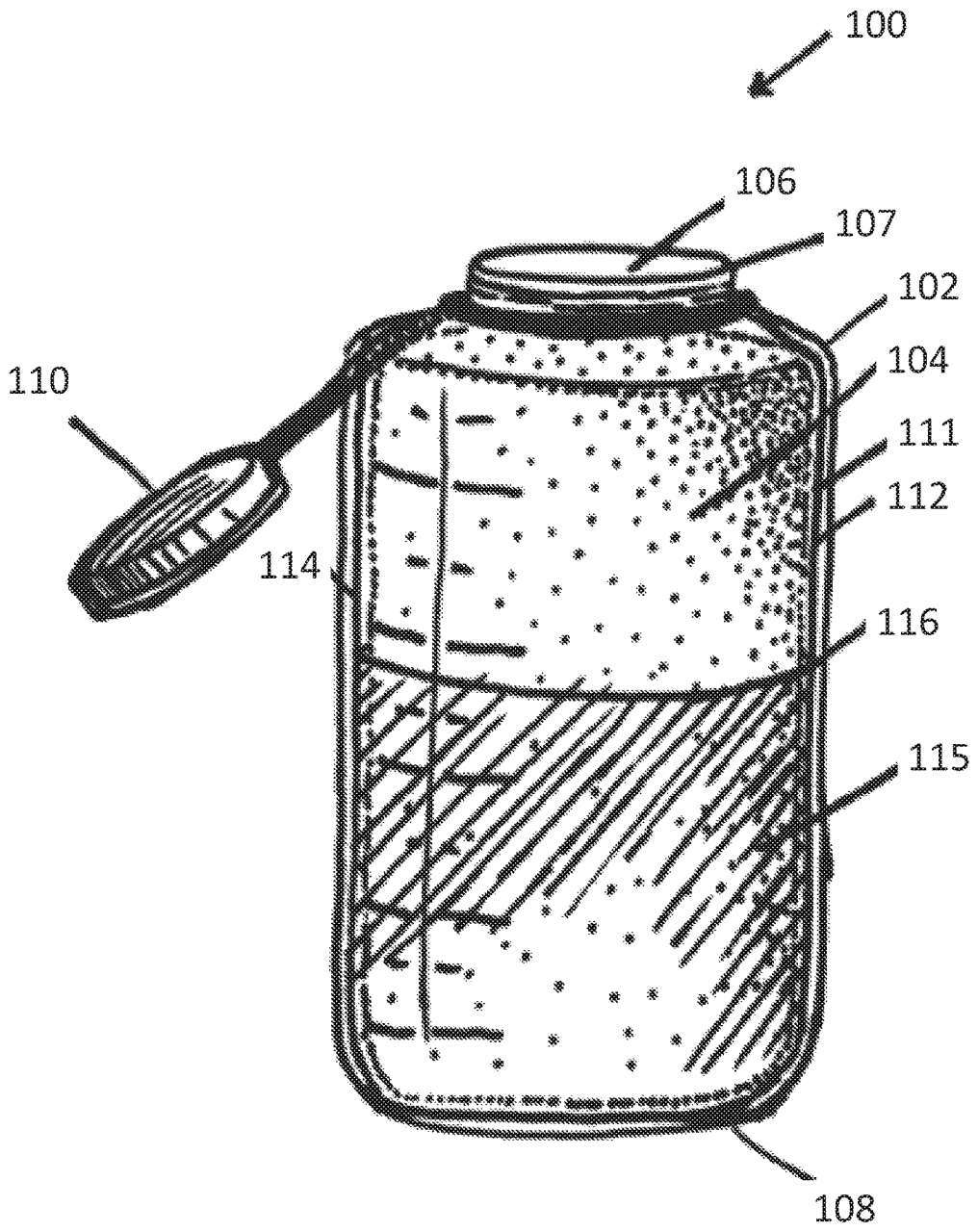
FIG. 1 shows a portable water bottle containing an exemplary insert, according to embodiments of the present disclosure.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

FIG. 1 depicts a portable water transport system 100, according to some embodiments. The portable water transport system 100 includes a portable water bottle 102 containing an insert 104. The portable water bottle 102 has an opening 106 at the top end 107 of the water bottle and a bottom 108 opposite top opening 106. Screwable cap 110 or some other sealing member may be flexibly attached to the opening 106.

Water bottle 102 has interior volume, defined by an inner surface 111 extending between a first side 112 of the water bottle 102 and a second side 114 of the water bottle 102. As shown in FIG. 1, water bottle 102 is approximately half filled with a liquid 115 up to line 116. Insert 104 expands to occupy the interior volume of water bottle 102, i.e., it expands to contact the inner surface 111 at both the first side 112 and the second side 114. Insert 104 also expands to extend from bottom 108 to just below opening 106, as shown in FIG. 1. In other embodiments, the insert 104 may have different heights. For example, in one embodiment the insert has a height that is around 50% of the height of the inner chamber of water bottle 102. In another embodiment, the insert 104 has a height that is around 80% of the height of the inner chamber of water bottle 102. For example, the insert may have a height that reaches the curved upper portion of a water bottle as it transitions from the wider body portion to the narrower opening. Still other embodiments may feature an insert 104 with a height that extends to the very top of water bottle 102 and is flush with the upper edge of opening 106, such that the insert 104 is in direct contact with cap 110 when the cap 110 is tightly screwed onto the opening 106. This reflects a height that is 100% the height of the inner chamber. In some embodiments, the insert may have a height that is slightly greater than the height of the inner chamber of the water bottle, e.g., about 105% the height of the inner chamber of the water bottle. In these embodiments, the cap will compress the insert when it is tightly screwed onto the opening.

Figure 2:
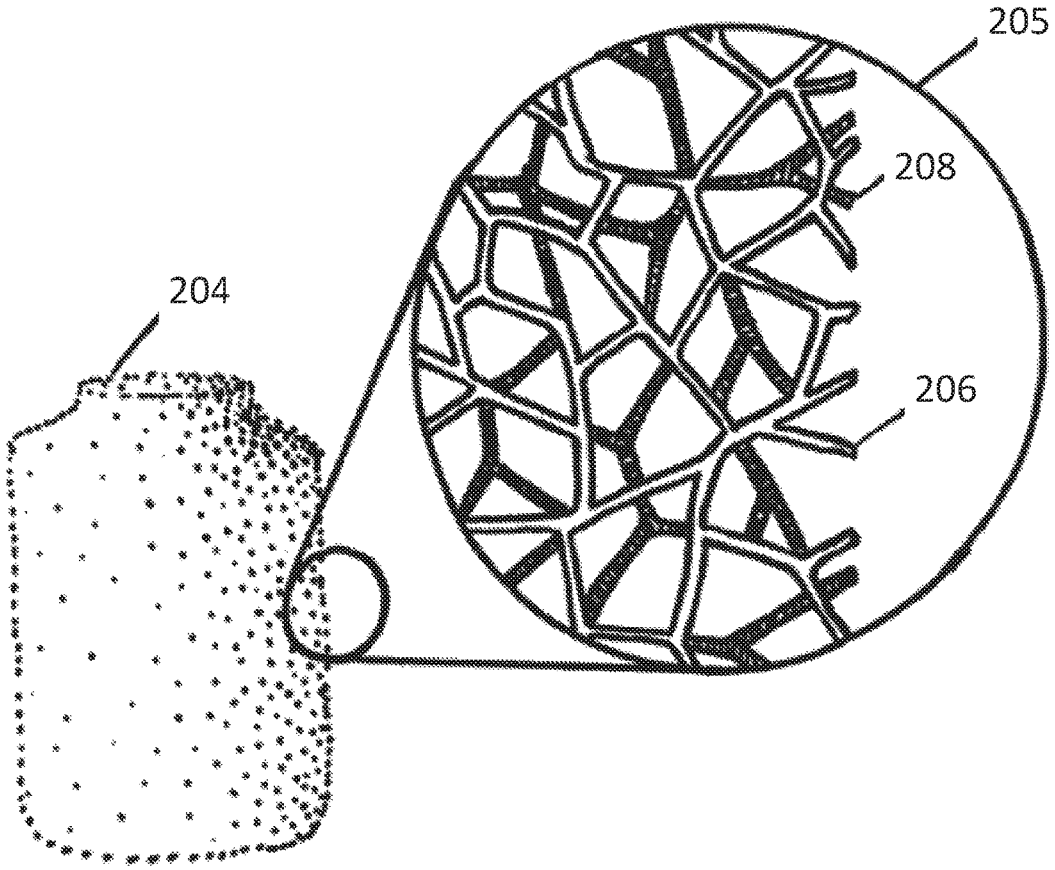
FIG. 2 shows an exemplary insert, according to embodiments of the present disclosure.
Figure 3:
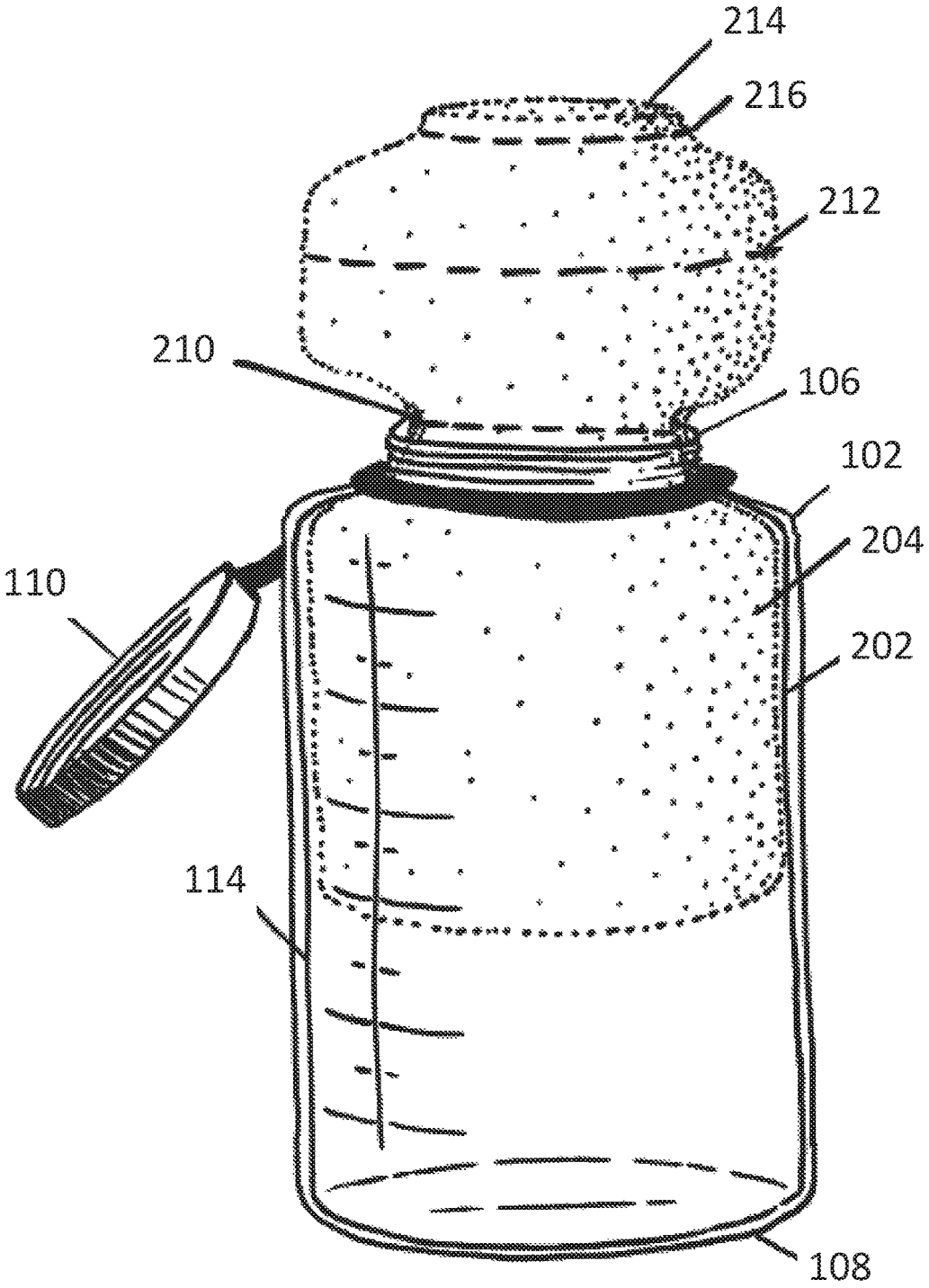
FIG. 3 shows the exemplary insert of FIG. 2 being placed inside of the portable water bottle of FIG. 1.

FIG. 2 shows an insert 204, according to some embodiments, while FIG. 3 illustrates insert 204 and water bottle 102 of FIG. 1. In these embodiments, insert 204 is shaped to roughly match or correspond to the interior volume of the portable water bottle 102. Insert 204 is formed of reticulated polyether foam, or other reticulated foam with a similar density. The reticulated foam in these embodiments is very porous, and is made up of a plurality of interconnected cells. In contrast to other foams, which consist of completely closed cells, the cells in the reticulated foam are almost completely open. Insert 205 in FIG. 2 shows a magnified view of the cell structure in the reticulated foam. Structures 206 and 208 are two examples of the structures that form the porous boundaries of the interconnected cells in insert 204.

Insert 204 allows liquid to flow within the insert, and if the water bottle is tipped, insert 204 allows liquid to flow out of opening 106 at a consumable rate. At the same time, insert 204 serves to slow down sudden bulk shifts of the liquid when the water bottle 102 is in motion. Insert 104 also prevents the noisy sloshing of the liquid, for example, by preventing the bulk of the liquid from slamming into inner surfaces 112 and 114 of water bottle 102.

The porosity of reticulated foam is measured by the frequency of the cells in a given length, often using the unit PPI, or pores per inch. Insert 204 has a porosity of between 10 and 18 PPI. Due to the previously discussed openness, while insert 204 expands to extend from interior wall to interior wall, and from bottom to top of water bottle 102, the actual cell structure of insert 204 (i.e., structures 206 and 208 in FIG. 2) displaces only 5% of the volume of portable water bottle 102. Lower porosity reticulated foams may occupy even less volume, such as only 2% of the volume of portable water bottle 102.

The size of the cells in insert 204, or cell density, is configured so as to restrict the free movement of liquid in water bottle 102, thereby reducing the noise created by liquid impacting the sides of water bottle 102. A higher density of cells (i.e., the smaller and more tightly packed the cells are) means liquid will have to divert around cell structures, such as structures 206 and 208 in FIG. 2, more frequently before any liquid can reach the wall of water bottle 102. Such diversions restrict the movement of the liquid within water bottle 102. This restriction of the movement of liquid within water bottle 102 and insert 204 also reduces the motion of water bottle 102 caused by liquid moving within water bottle 102, including, for example, water slamming into the interior walls. This sloshing motion can be irritating and disruptive during activities such as running or hiking.

In addition to reducing noise and motion, the porosity of the insert 204 is also configured to allow liquid to flow out of portable water bottle 102 at a rate comfortable for drinking, also referred to as a consumable rate. Likewise, the porosity of the foam of insert 204 is configured to allow water bottle 102 to be filled in a timely fashion. Thus, the porosity of the reticulated foam in insert 204 is configured to balance the goals of reducing sloshing noise and associated motion with allowing liquid to flow fast enough to conveniently fill and drink liquid from water bottle 102 at a consumable rate. In addition, the volumetric density of the reticulated foam may be between 1.4 and 2.5 pounds per cubic foot (PCF) or between 1.8 and 2.2 pounds per cubic foot.

Insert 204 is capable of withstanding temperatures up to 250 degrees Fahrenheit, meaning that insert 204 can be cleaned in boiling water. Insert 204 is also easy to shape, such that it can be adapted to fit other portable water bottle shapes by cutting or trimming excess foam from the edges in order to conform the expanded shape to the interior volume of a different liquid container. Finally, insert 204 is very lightweight, weighing only 25 grams when tailored for a water bottle of about 1000 ml.

Testing was performed on a water bottle with an exemplary insert placed inside of that water bottle. The insert had a porosity of 10 PPI. The testing consisted of filling the water bottle full with 1000 ml of water, titling the water bottle down at an angle of 80 degrees (with 90 degrees being horizontal), and then measuring the time required for half of the water to drain from the water bottle. These results are shown in Table 1, below.

TABLE 1

| Test Configuration | Time for 500 ml to drain |
|---|---|
| 1 L water bottle, full, with insert | 5 seconds |
| 1 L water bottle, full, no insert | <1 second |

Additional testing was done using that insert to identify the sound reduction properties of the insert. In particular, the insert was placed inside a water bottle, which was then was filled with 350 ml of water so that about one third of the water bottle was filled. The water bottle was moderately agitated and the resulting noise was measured from 12 inches away from the water bottle. This was repeated using a water bottle without the insert. The results are shown below in Table 2.

TABLE 2

| Test Configuration | Noise |
|---|---|
| 1 L water bottle containing 350 ml of water and insert | 40 db |
| 1 L water bottle containing 350 ml of water | 60 db |

FIG. 3 shows the insert 204 being placed inside of the portable water bottle 102, according to some embodiments. The cross-sectional profile of insert 104, as well as its compressibility, can be seen in FIG. 3. For example, a middle portion of the insert 104 is compressed to fit inside opening 106, creating a cross-sectional profile, as shown by dashed line 210, matching the cross-sectional profile of water bottle 102 at the opening 106. The compressibility of insert 204 and ease of use results in relatively little friction during insertion. Once inside water bottle 102, insert 204 expands to extend from interior wall 112 to opposite interior wall 114. In other words, insert 204 expands to match the cross-sectional profile of the inner volume of water bottle 102. The insert 204 may be customized to the water bottle 102, such that its cross-sectional profile in a fully-expanded shape, as shown by dashed line 212, corresponds to the cross-sectional profile of the inner volume of water bottle 102. In addition, the cross-sectional profile of an upper portion 214 of the insert 204 can be adapted to fit the shape of the neck of portable water bottle 102, as indicated by dashed line 216. The cross-sectional profile of insert 204 can be adapted, for example, by cutting or trimming excess foam from the edges in order to conform the expanded shape to the interior volume of water bottle 102.

In some embodiments, the inserts are not homogeneous and may be made with void areas added for various reasons, such as to aid compressibility.

Figure 4:
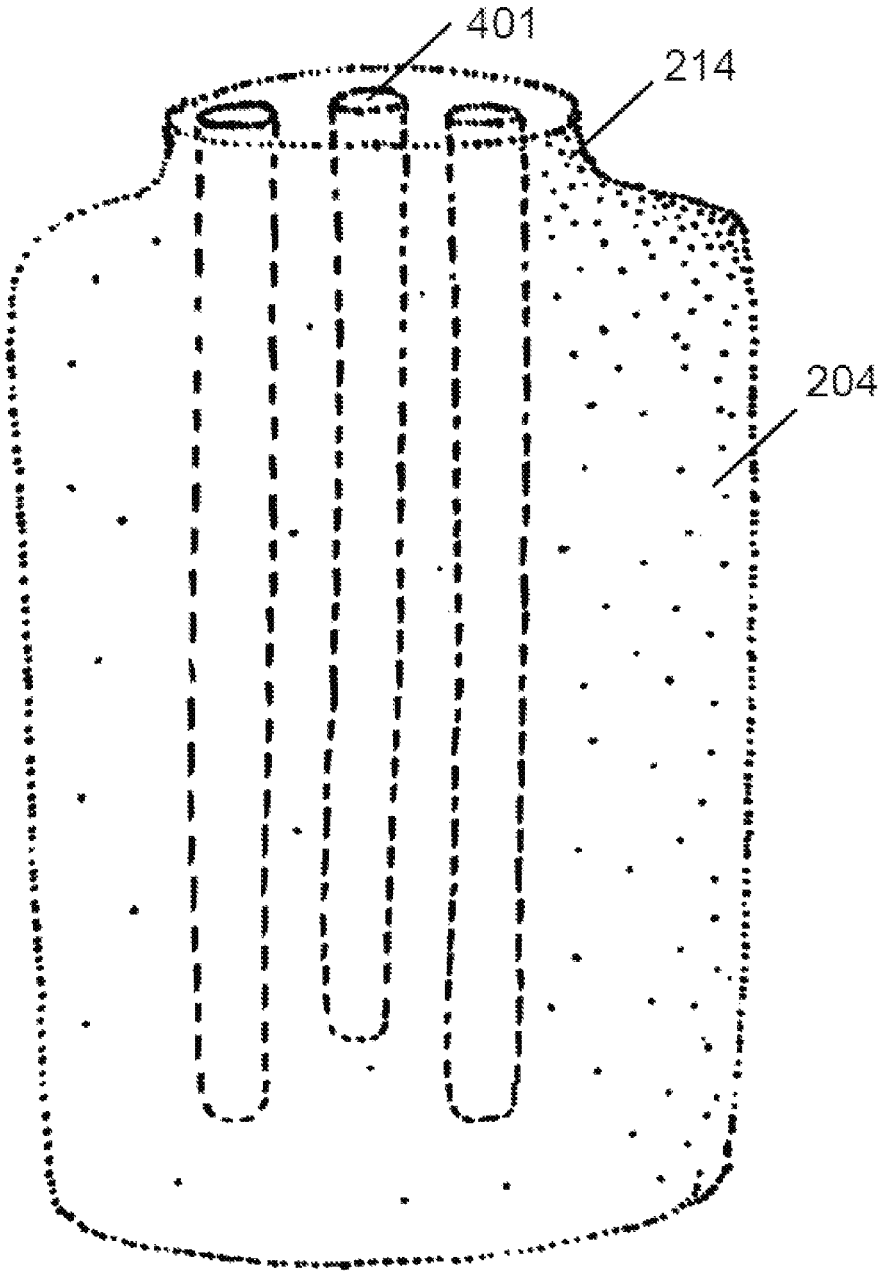
FIG. 4 shows an exemplary insert with longitudinal cuts.
Figure 5:
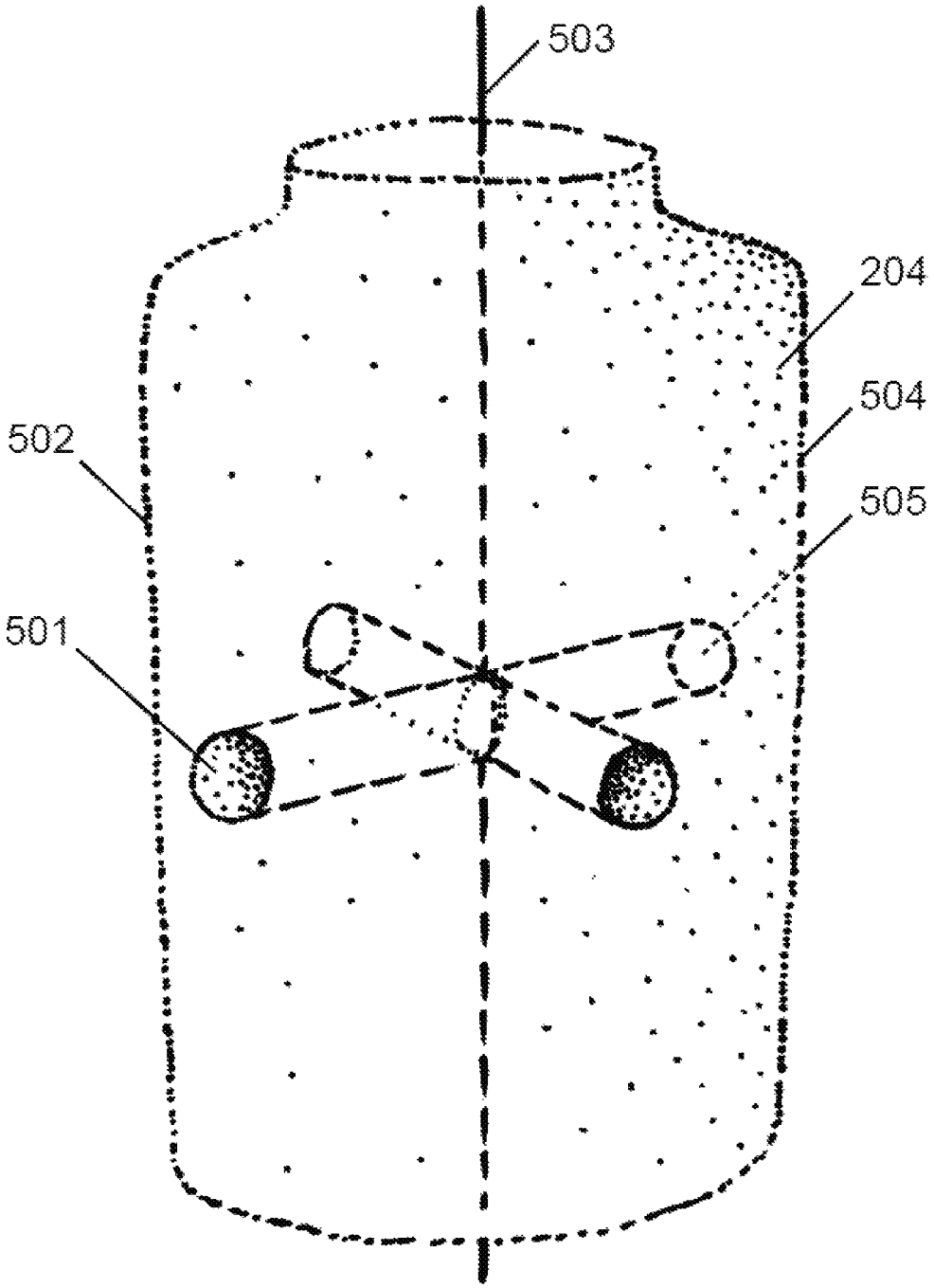
FIG. 5 shows an exemplary insert with radial cuts.
Figure 6:
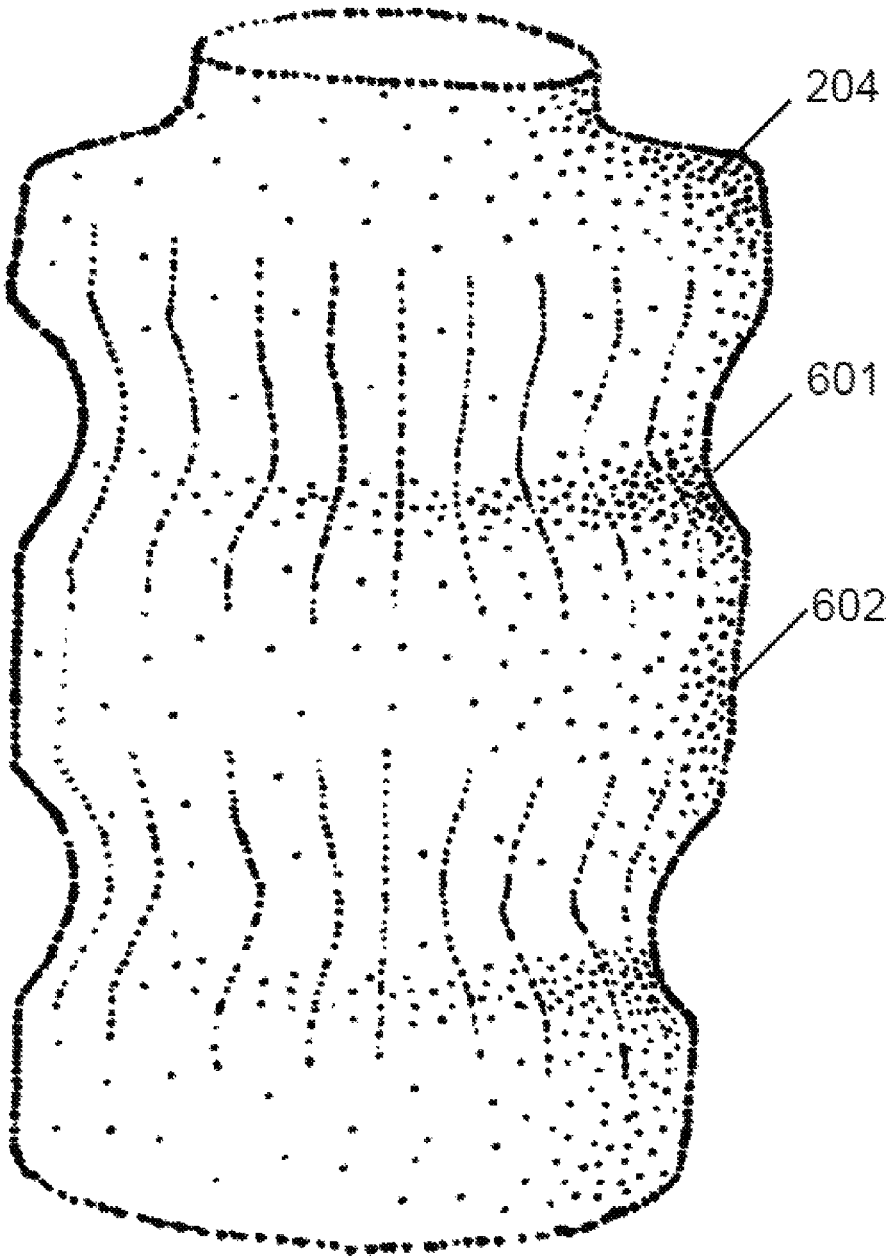
FIG. 6 shows an exemplary insert with circumferential cuts.

FIGS. 4, 5, and 6 show embodiments in which insert 204 can be further adapted by cutting or trimming the foam material. For example, FIG. 4 shows several longitudinal cuts or bores made in insert 204. Longitudinal cut 401 runs through the upper portion 214 of insert 204 and continues through a substantial portion of insert 204. While longitudinal cut 401 has a cylindrical profile, in other embodiments the cut could have a different profile, such as triangular, square, or hexagonal, for example. In some embodiments, longitudinal cut 401 runs the entire length of insert 204 through a top surface of the insert 204 and through the bottom surface of insert 204. In other embodiments, cut 401 spans only a small distance from the top of the insert 204 or a small distance from the bottom of the insert 204. The cut may extend through the top surface and/or the bottom surface, or may create a largely internal void. In some embodiments, the cut may taper as it approaches the top and/or bottom surfaces of the insert 204.

In some embodiments, the insert has a plurality of cuts or bores, while in other embodiments the insert has only a single cut or bore. The cut or cuts may be along a longitudinal axis (e.g., 503 in FIG. 5) or may be arranged around the longitudinal axis.

FIG. 5 shows two radial cuts made in insert 204. Radial cut 501 runs from side wall 502, through center longitudinal axis 503, to opposite side wall 504. While radial cut 501 has a cylindrical profile in FIG. 5, the cut could have other profiles, such as triangular, square, or hexagonal, for example. Additional radial cuts, not shown in FIG. 5, could be made above and/or below radial cut 501. As discussed above with respect to cut 401, in different embodiments the cuts may span different lengths, have different configurations, and be placed in different locations. While in FIG. 5 the two radial cuts intersect, in other embodiments multiple radial cuts may be separate or may only partially intersect.

FIG. 6 shows circumferential cuts made in insert 204. Circumferential cut 601, cut from side wall 602, runs the entire circumference of insert 204. One or more circumferential cuts may be made in insert 204, of varying depth into insert 204. Although FIG. 6 shows circumferential cut 601 with a sinusoidal profile, cut 601 may additional be circular, square, rectangular, or other shapes in profile. Circumferential cut 601 may only be cut into a portion of the circumference of insert 204, or may extend around the entire circumference of insert 204. As discussed above with respect to cut 401, in different embodiments the cuts may span different lengths, have different configurations, and be placed in different locations.

In some embodiments, the insert 204 may include one or more longitudinal cuts, radial cuts, and/or circumferential cuts. A cut may combine one or more aspects of each type of cut to create additional profiles, such as a helical spiral.

In some embodiments, these cuts (e.g., the cuts shows in FIGS. 4, 5, and 6) serve to reduce the weight of insert 204 and ease insertion of insert 204 by increasing compressibility. In addition, the cuts, such as cut 401 shown in FIG. 4, may aid in ensuring water flows out of insert 204 at a consumable rate.

Figure 7:
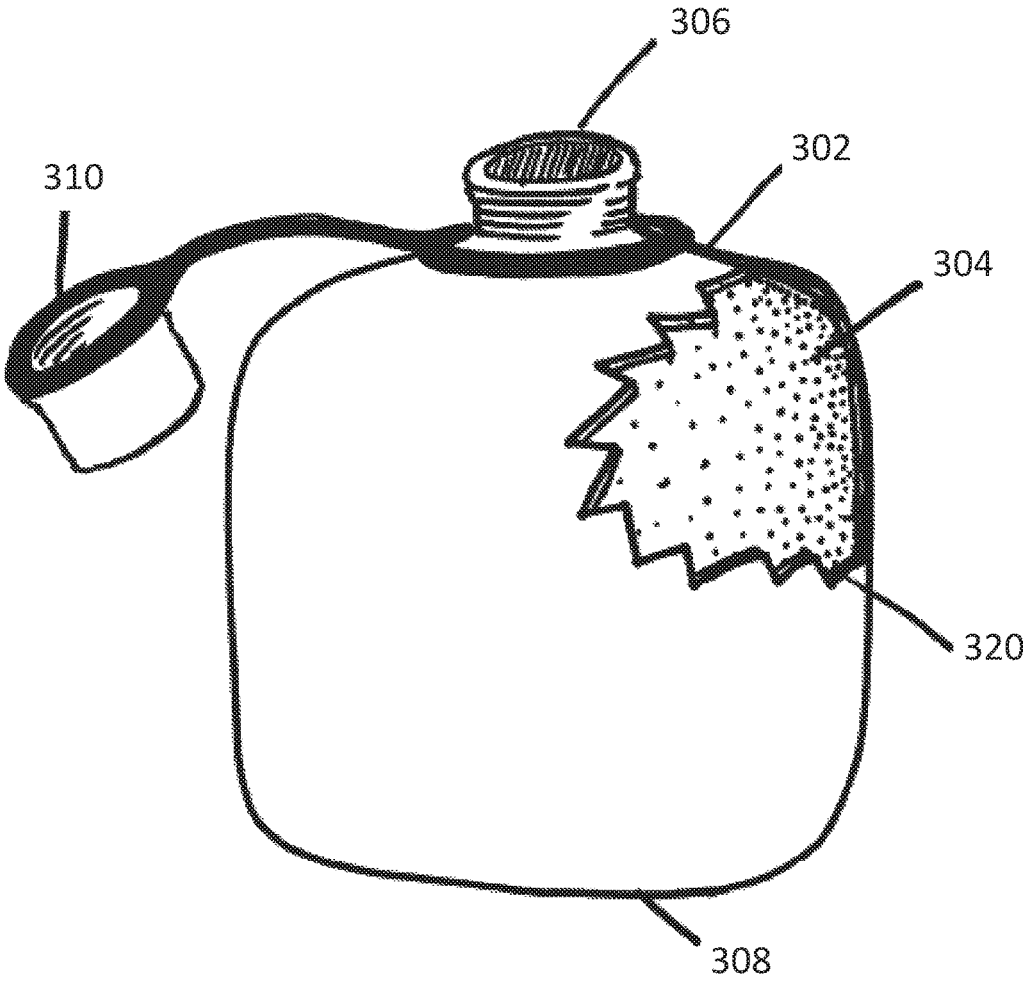
FIG. 7 shows a portable canteen containing an exemplary insert, according to embodiments of the present disclosure.

FIG. 7 shows insert 304 placed inside of portable canteen 302, according to some embodiments. Portable canteen 302 includes an opening 306 that can be sealed with a lid 310. FIG. 4 has a cutaway section 320 to reveal insert 304 inside of canteen 302. Insert 304 expands to extend from canteen bottom 308 to opening 306.

Figure 8:
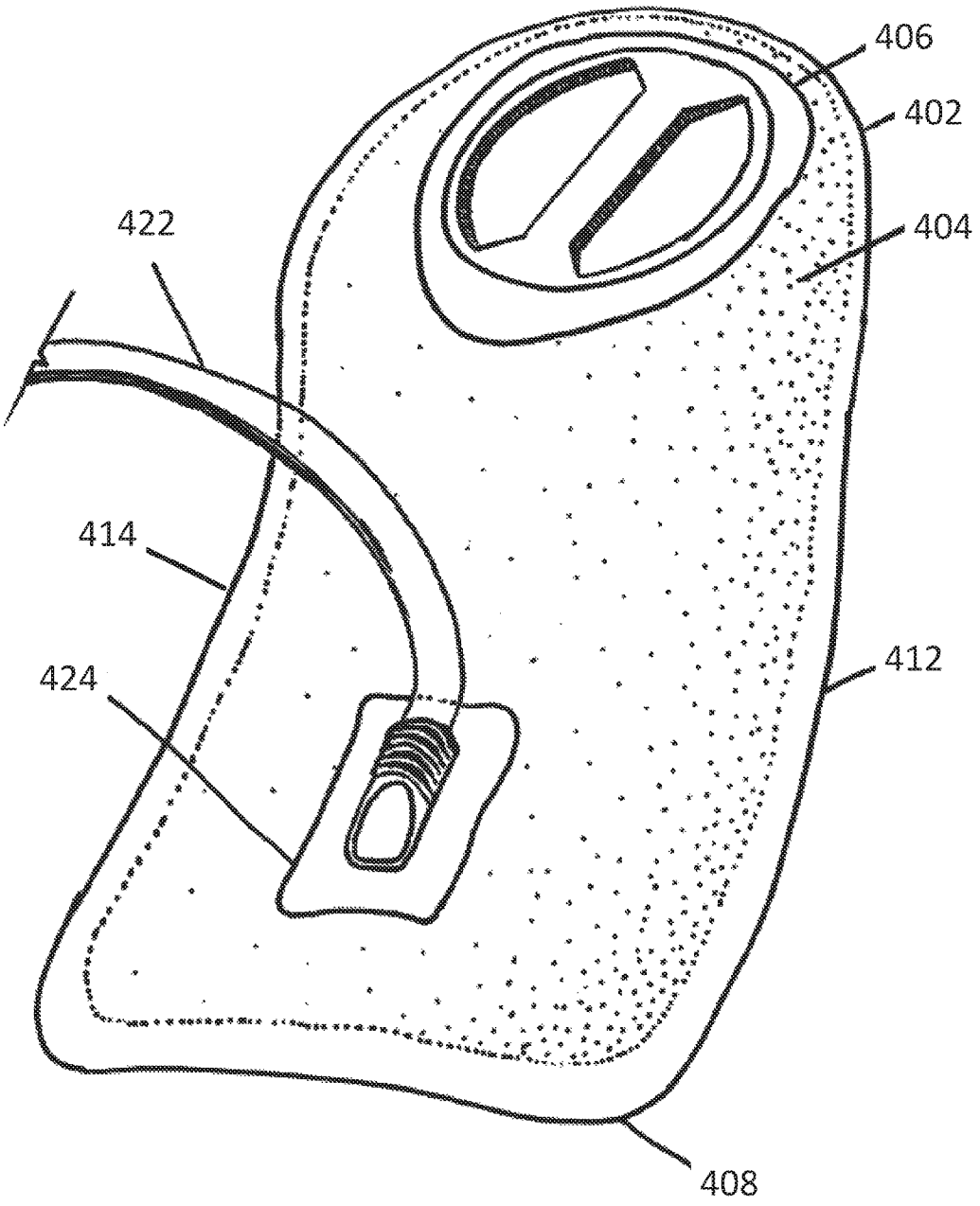
FIG. 8 shows a portable water bladder containing an exemplary insert, according to embodiments of the present disclosure.

FIG. 8 shows insert 404 placed inside of portable water bladder 402. Portable water bladder 402 is translucent, so insert 404 can be seen inside of water bladder 402. Insert 404 expands to extend from bottom 408 to opening 406. Insert 404 expands to extend from side wall 412 to the opposite side wall 414. Insert 404 may be placed inside of portable water bladder 402 by unscrewing the cover from opening 406. Liquid is consumed via tube 422 that is attached at a lower portion 424 of the water bladder 402.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What is claimed is:

1. A portable liquid transport system that reduces liquid sloshing noises during movement, the system comprising:

a portable container configured to store liquid and transmit the liquid through an opening in the portable container; and a foam insert having a compressed profile sized to pass through the opening of the portable container and an expanded profile in which the foam insert contacts an interior surface of the portable container while occupying less than 5% of a volume of the portable container, the foam insert being formed by a plurality of cells in fluid communication with one another, the cells being configured to substantially reduce liquid sloshing noises while allowing liquid to pass through the cells and the opening at a consumable rate.

2. The portable liquid transport system of claim 1, wherein the expanded profile of the foam insert is configured to contact points of the interior surface located on opposite sides of the portable container.

3. The portable liquid transport system of claim 1, wherein the foam insert prevents liquid sloshing noise from exceeding 50 db during activities that jostle the portable liquid transport system.

4. The portable liquid transport system of claim 1, wherein the foam insert is formed of a resilient material configured to attenuate movement of liquid inside the transport system.

5. The portable liquid transport system of claim 1, wherein the expanded profile of the foam insert has a profile that substantially corresponds to a profile of an inner chamber of the portable container.

6. The portable water transport system of claim 1, wherein the foam insert comprises reticulated polyether.

7. The portable water transport system of claim 6, wherein the reticulated polyether is stable up to temperatures of 250 degrees Fahrenheit.

8. The portable water transport system of claim 6, wherein the reticulated polyether has between 10-30 pores per inch.

9. The portable water transport system of claim 1, wherein the compressed profile of the foam insert has a cross sectional shape that corresponds to a shape of the opening of the portable container.

10. The portable water transport system of claim 1, wherein the expanded profile of the foam insert has a cross sectional shape that corresponds to a cross sectional shape of an inner chamber of the portable container.

11. The portable water transport system of claim 1, wherein the portable container includes an inner chamber having-a height and a width, wherein the expanded profile of the foam insert has a width corresponding to the width of the inner chamber and wherein the expanded profile of the foam has a height that is between 50% and 80% of the height of the inner chamber.

12. The portable water transport system of claim 1, wherein the portable container has a height and a width, wherein the expanded profile of the foam insert has a width corresponding to the width of the portable container, and wherein the expanded profile of the foam insert has a height that is between 90% and 105% of the height of the portable container.

13. A reticulated foam configured to attenuate movement and sloshing noises from a liquid in a portable container, the reticulated foam comprising:

a plurality of interconnected cells with openings between the cells configured to facilitate movement of a liquid through the cells at a consumable rate, the boundaries of the plurality of interconnected cells reducing movement and sloshing noise of the liquid;

wherein the boundaries of the plurality of interconnected cells prevent sloshing noises of the liquid from exceeding 50 db.

14. The reticulated foam of claim 13, wherein the reticulated foam allows the liquid to pass through an opening in a portable container in which the reticulated foam is placed at a consumable rate.

15. The reticulated foam of claim 13, wherein the interconnected cells are configured to facilitate passage of the liquid from a lower portion of a portable container in which the reticulated foam is placed to an upper portion of the portable container at the consumable rate.

16. A potable liquid transportation apparatus comprising:

an insert formed from reticulated foam, the insert having a first profile in which an outer perimeter of the insert has a size and a shape that substantially corresponds to an inner chamber of a portable container configured for carrying a potable liquid, the insert having a second profile in which an outer perimeter of the insert has a size and a shape that substantially corresponds to an opening of the portable container, the reticulated foam having a cell density that prevents sloshing noises resulting from jostling movement of the portable container from exceeding 60 db while enabling the potable liquid to exit the portable container at a consumable rate.

17. The apparatus of claim 16, wherein the first profile of the insert has a height that is between 50% and 100% of a height of the portable container.

18. The apparatus of claim 16, wherein the first profile of the insert has a height that is between 95% and 105% of a height of the inner chamber of the portable container.

19. The apparatus of claim 16, wherein the first profile of the insert is configured to attenuate movement of the potable liquid from a lower portion of the portable container to an upper portion of the portable container.

* * * * *